US009133576B2

(12) United States Patent
Lee et al.

(10) Patent No.: US 9,133,576 B2
(45) Date of Patent: Sep. 15, 2015

(54) DETERGENT SUPPLY APPARATUS AND WASHING MACHINE

(75) Inventors: Jong Min Lee, Seoul (KR); Young Ho Kim, Seoul (KR); Jae Hyun Kim, Seoul (KR); Sang Hoon Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 1300 days.

(21) Appl. No.: 12/453,841

(22) Filed: May 22, 2009

(65) Prior Publication Data

US 2009/0288452 A1 Nov. 26, 2009

(30) Foreign Application Priority Data

May 23, 2008 (KR) ..... 10-2008-0048190

(51) Int. Cl.
*D06F 39/02* (2006.01)
*D06F 39/12* (2006.01)

(52) U.S. Cl.
CPC ..... *D06F 39/022* (2013.01); *D06F 39/02* (2013.01); *D06F 39/125* (2013.01)

(58) Field of Classification Search
CPC ..... D06F 39/02; D06F 39/022; D06F 39/125
USPC ..... 68/12.18, 17 R, 207, 902; 222/173, 222/181.1–181.3, 182, 386
See application file for complete search history.

(56) References Cited

U.S. PATENT DOCUMENTS

| | | | | |
|---|---|---|---|---|
| 3,139,890 | A * | 7/1964 | Moran | 134/100.1 |
| 5,709,237 | A * | 1/1998 | Sargeant et al. | 134/174 |
| 5,743,432 | A | 4/1998 | Barbe | |
| 5,870,906 | A * | 2/1999 | Denisar | 68/17 R |
| 6,109,480 | A | 8/2000 | Monsrud et al. | |
| 6,945,504 | B2 * | 9/2005 | Chen et al. | 248/282.1 |
| 7,261,268 | B2 * | 8/2007 | Kunesh et al. | 248/310 |
| 8,056,747 | B2 * | 11/2011 | Vitan et al. | 220/23.83 |
| 2008/0028802 | A1 * | 2/2008 | Jordan et al. | 68/12.18 |
| 2009/0095750 | A1 * | 4/2009 | Vitan et al. | 220/23.83 |
| 2010/0139328 | A1 * | 6/2010 | Favaro | 68/12.18 |

FOREIGN PATENT DOCUMENTS

| | | | |
|---|---|---|---|
| DE | 20304045 | U1 * | 7/2003 |
| EP | 268451 | A2 * | 5/1988 |
| EP | 1 884 584 | | 2/2008 |
| FR | 2352094 | A1 * | 12/1977 |
| GB | 2 214 524 | | 9/1989 |
| GB | 2214524 | A * | 9/1989 |
| GB | 2 377 927 | | 1/2003 |
| JP | 62-104780 | | 7/1987 |
| JP | 63-043698 | | 2/1988 |
| KR | 10-0758363 | | 9/2007 |
| KR | 779404 | B1 * | 11/2007 |
| WO | WO 0208509 | A1 * | 1/2002 |
| WO | WO 2006/073885 | | 7/2006 |

* cited by examiner

*Primary Examiner* — Michael Barr
*Assistant Examiner* — Kevin G Lee
(74) *Attorney, Agent, or Firm* — Dentons US LLP

(57) ABSTRACT

A washing machine according to an exemplary embodiment of the present invention includes a washing tub that washes laundry; a storage drawer provided under the washing tub; a detergent bottle seat provided inside of the storage drawer, a detachable detergent bottle containing a liquid detergent being seated on the detergent bottle seat; a detergent bottle connecting part connected to the detergent bottle, the liquid detergent flowing into through the detergent bottle connecting part; and a detergent pump that supplies the liquid detergent to the washing tub.

11 Claims, 9 Drawing Sheets

DETERGENT SUPPLY APPARATUS AND WASHING MACHINE

This application claims the benefit of Korean Patent Application No. 10-2008-0048190 filed on May 23, 2008, which is hereby incorporated by reference for all purposes as if fully set forth herein.

BACKGROUND OF THE INVENTION

1. Field of the Invention

The disclosure relates to a detergent supply apparatus and a washing machine, and more specifically to a detergent supply apparatus and a washing machine that may automatically supply a liquid detergent.

2. Discussion of the Related Art

In general, a washing machine is an appliance that cleans laundry (i.e. clothing, linens, bedclothes, towels, etc., hereinafter laundry) via washing, rinsing, and dehydrating processes using water, detergent, and various mechanical operations.

Conventional washing machines generally include a washing tub that is adapted to receive water, detergent, and laundry and arranged to rotate within a washing cabinet via a driving apparatus to wash the laundry. In addition, conventional washing machines further include a water supply apparatus that supplies water into the washing tub and a water discharge apparatus that discharges the soiled water from the washing tub outside. A detergent supply apparatus is arranged over the water supply fluid passage of the water supply apparatus to supply a detergent to the inside of the washing tub. The detergent supply apparatus includes a dispenser in fluid communication with the water supply fluid passage and a detergent box that is arranged to be removable from the dispenser and to accommodate various detergents.

In conventional washing machines, therefore, the detergent box is withdrawn from the dispenser, a powder- or liquid-type detergent is supplied in the detergent box, and then the detergent box is inserted back into the dispenser. When the water supply apparatus operates, the powder or liquid-type detergent in the detergent box is supplied into the inside of the washing tub along with water flowing through the water supply fluid passage of the water supply apparatus.

Conventional washing machines have the disadvantage in that the process of supplying detergent into the detergent box tends to be tedious and time consuming to the user as it needs to be done manually for every wash cycle. This results in diminishing the convenience of the washing machine to the user. Furthermore, the amount of detergent supplied in the detergent box must be determined intuitively by the user, and therefore, the amount of detergent supplied may be excessive or inadequate, resulting in over-consumption and waste of the detergent or decreasing washing capacity.

SUMMARY

Technical Problem

A feature of the exemplary embodiments of the present invention is to provide a detergent supply apparatus and a washing machine which may automatically supply a predetermined amount of detergent.

Another feature of the exemplary embodiments of the present invention is to provide a detergent supply apparatus and a washing machine which may automatically supply a liquid detergent by readily using a commercially available detergent bottle containing a liquid detergent.

The features of the exemplary embodiments of the present invention are not limited to the above ones, and other features not referred to may be understood by those skilled in the art from the below descriptions.

Technical Solution

A detergent supply apparatus according to an embodiment of the present invention includes: a storage area provided under a washing space in which washing is performed; a detergent bottle seat provided inside of the storage area adapted to receive a detergent bottle containing a liquid detergent; a detergent bottle connecting part adapted to be secured to the detergent bottle and provide a flow path for the liquid detergent to enter the supply apparatus; and a pump adapted to supply the liquid detergent to the washing space A washing machine according to an embodiment of the present invention includes: a washing tub that washes laundry; a storage area provided under the washing tub; and a liquid detergent supply apparatus disposed inside the storage area including: a detergent bottle seat adapted to receive a detergent bottle containing a liquid detergent; a detergent bottle connecting part adapted to be secured to the detergent bottle and provide a flow path for the liquid detergent to enter the liquid supply apparatus; and a pump adapted to supply the liquid detergent to the washing tub.

Details of these and other embodiments of the present invention will be given with reference to the detailed descriptions and accompanying drawings.

Advantageous Effects

A detergent supply apparatus and washing machine of the present invention have multiple advantageous effects as follows:

Firstly, there is an advantage of automatically supplying a predetermined amount of liquid detergent during washing.

Secondly, there is an advantage of improving a user's convenience resulting from a use of commercially available detergent bottles containing liquid detergent.

Thirdly, there is an advantage that the detergent bottle is easily detachable and any detachable detergent bottle may be adapted to be received inside the washing machine.

The effects of the present invention are not limited to the above ones and other effects not referred to may be understood by those skilled in the art from the accompanying claims.

DETAILED DESCRIPTION

Figure 1:
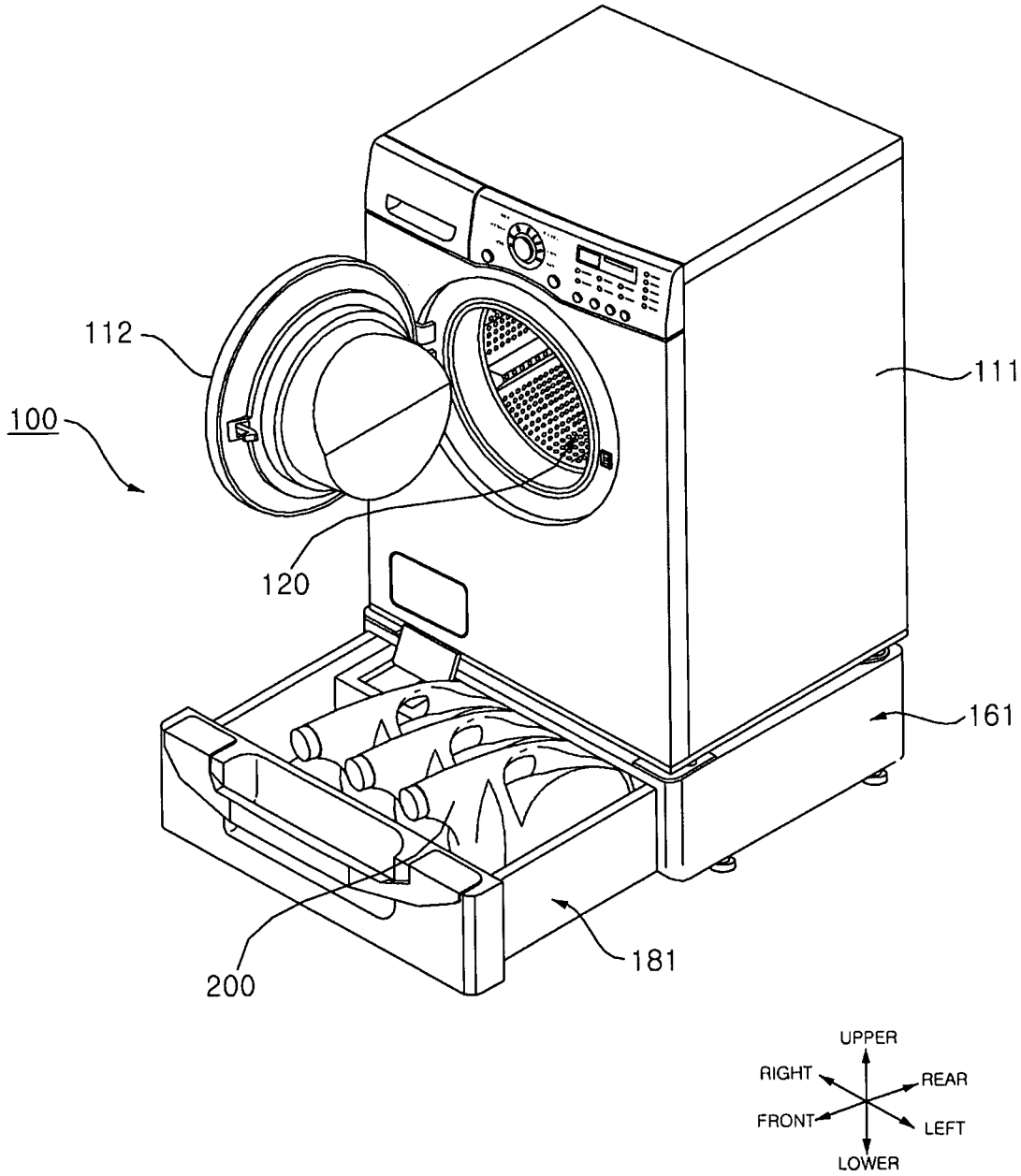
FIG. 1 is a perspective view illustrating a washing machine according to an embodiment of the present invention.

The advantages and features of the present invention and methods of achieving them will be apparent from the following exemplary embodiments that will be described in more detail with reference to the accompanying drawings. It should be noted, however, that the present invention is not limited to the following exemplary embodiments, and may be implemented in various forms. Accordingly, the exemplary embodiments are provided only to disclose the present invention and let those skilled in the art know the category of the present invention; the scope of the present invention is defined by accompanying claims. Throughout the specification, the same reference numerals refer to the same elements.

Hereinafter, the present invention will be described by its exemplary embodiments with reference to the accompanying drawings that illustrate a detergent supply apparatus and a washing machine.

Figure 2:
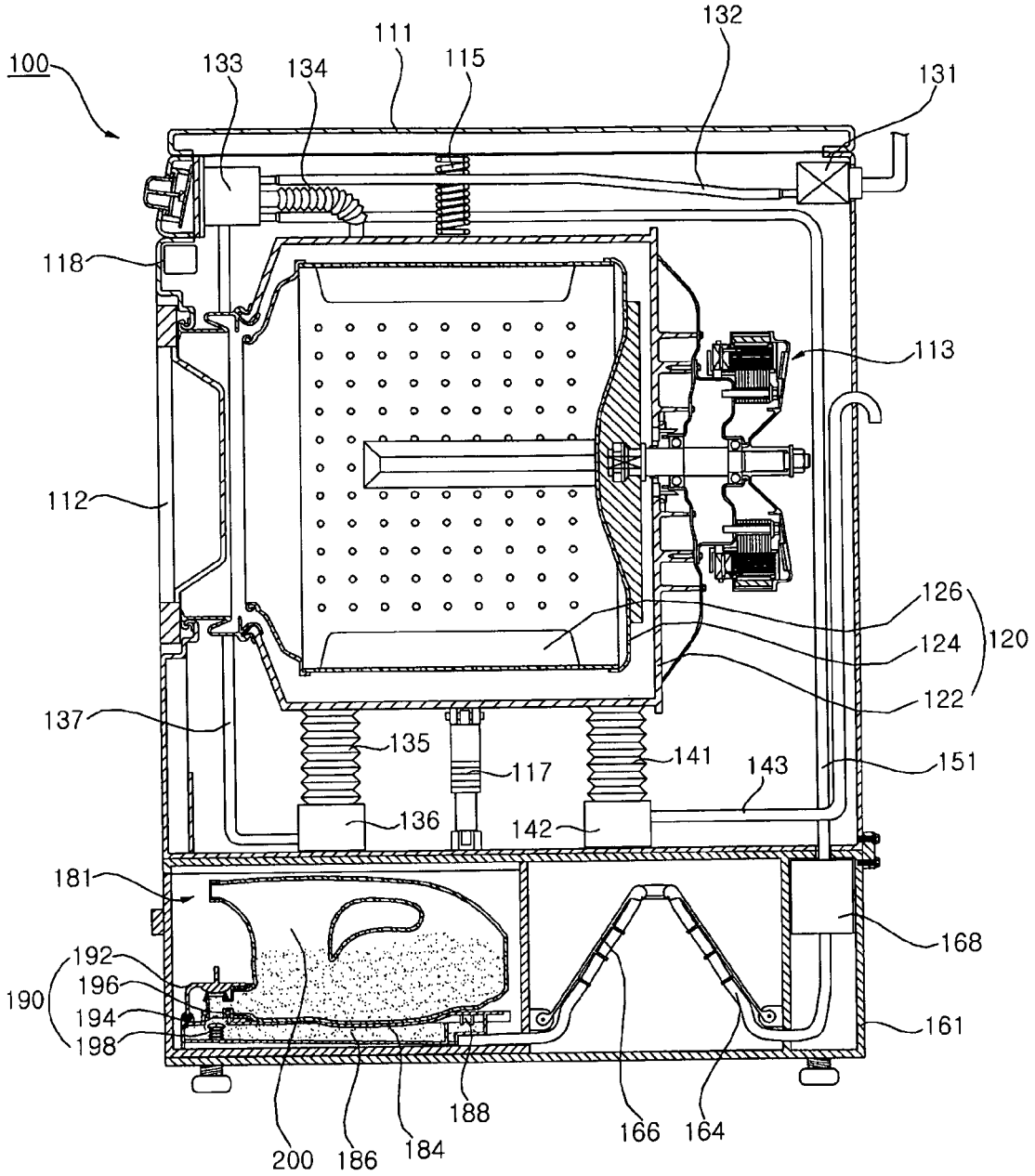
FIG. 2 is a side cross sectional view of the washing machine shown in FIG. 1.
Figure 3:
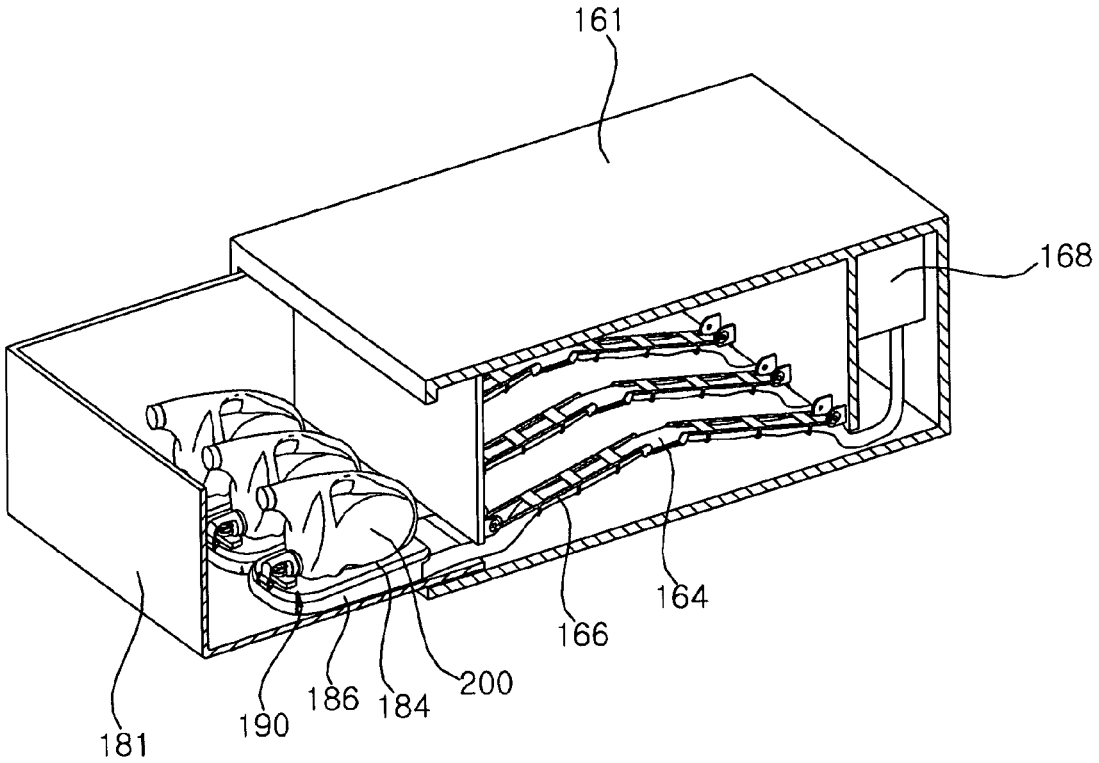
FIG. 3 is a partially exploded perspective view of the storage drawer of the liquid detergent delivery system of the washing machine shown in FIG. 1.

FIG. 1 is a perspective view illustrating a washing machine according to an embodiment of the present invention, FIG. 2 is a side cross sectional view of the washing machine illustrated in FIG. 1, and FIG. 3 is a partially exploded perspective view of the storage drawer and the liquid detergent delivery apparatus illustrated in FIG. 1.

A washing machine 100 according to an embodiment of the present invention includes a case 111 defining an external appearance of the washing machine 100, a door 112 opening and closing a side surface of the case 111 so that laundry may be put into and removed from the inside of the case 111, a washing tub 120 provided in the inside of the case 111 to wash the laundry, a storage drawer 181 provided under the washing tub 120, and a supporting frame 161 provided under the case 111 and having a storage drawer 181.

The washing tub 120, in which laundry, liquid detergent, and washing water are supplied and washing is done, is arranged in the inside of the case 111 to be shock-absorbed by a spring 115 and a damper 117. Preferably, the washing tub 120 includes a tub 122 for accommodating washing water and liquid detergent therein, and a drum 124 rotatably arranged inside the tub 122 to accommodate the laundry therein. The drum 124 may have a plurality of apertures through which the washing water and the liquid detergent pass in the tub 122, and a lifter 126 arranged on an inner surface of the drum 124 to lift and drop the laundry at a predetermined height upon rotation of the drum 124. The drum 124 rotates by a rotation force exerted from a driving part 113 provided in the case 111. Further, the functioning of the washing machine may be controlled via a controller 118.

As illustrated in FIG. 2, it is preferable that a washing water supply valve 131, a washing water supply fluid passage 132, a mixing part 133, and a liquid detergent/water delivery passage 134 are provided on the inside of the case 111. The washing water supply valve 131 may supply washing water from an external water source, and the washing water flows through the washing water supply fluid passage 132 and the washing water supply valve 131 into the mixing part 133. The mixing part 133 mixes the washing water with a liquid detergent, and the mixed water and detergent may flow into the tub 122 via a liquid detergent/water delivery passage 134.

Furthermore, it is preferable that a circulation tube 135, a circulation pump 136, and a circulation fluid tube 137 are provided in the case 111. Other configurations, however, are within the scope of the invention. The circulation tube 135 provides a passage for the washing water and liquid detergent to exit the tub 122 to be circulated by the circulation pump 136. The circulation fluid tube 137 provides a passage for the washing water and liquid detergent to flow into the mixing part 133.

It is also preferable that a water discharge tube 141, a water discharge pump 142, and a water discharge fluid passage 143 are provided in the case 111. Again, other configurations are within the scope of the invention. The water discharge tube 141 provides a passage for the used washing water and liquid detergent to exit and be discharged from the tub 122 as it is pumped by the water discharge pump 142. The water discharge fluid passage 143 then provides a passage for the washing water and liquid detergent to be discharged outside the washing machine 100.

It is understood that the structure and arrangement inside the washing tub 120 and the case 111 described above may be altered by those skilled in the art.

The storage drawer 181 includes a detergent bottle seat 184 on which a detachable detergent bottle 200 containing a liquid detergent may be seated. A detergent bottle connecting part 190 may also be provided in the storage drawer 181 to connect the detergent bottle 200 to the reservoir 186 such that the liquid detergent may flow therethrough. The liquid detergent may flow passively, by the force of gravity, through the detergent bottle connecting part 190 and is stored in the reservoir 186.

The detergent bottle seat 184 may be preferably provided in plurality so that a plurality of detergent bottles may be seated on one or more detergent bottle seats 184. Each of the plurality of detergent bottles may contain detergents, such as a liquid detergent for washing, a liquid detergent for rinsing (fabric softener), and a liquid detergent for bleaching. Three detergent seats 184 are illustrated in the exemplary embodiment of FIG. 3. The detergent bottle seat 184 is preferably formed to fit the shape of a surface of the detergent bottle 200, and may be formed of an elastic member which may be deformed to fit the shape of the surface of the detergent bottle 200 in contact with the seat 184. Various methods of implementing the detergent bottle seat 184 will be described later with reference to FIGS. 6 to 8.

The detergent bottle 200 may be detachable and in one embodiment, any commercially available detergent bottle containing a liquid detergent may be utilized as the detergent bottle 200 without adaptation. In addition, a liquid detergent may be stored and used in the detergent bottle provided together with the washing machine. The detergent bottle connecting part 190 connects the detergent bottle 200 with the detergent reservoir 186. The detergent bottle connecting part 190 is preferably provided in plurality so that a plurality of detergent bottles may be used. The detergent bottle connecting part 190 includes a detergent bottle fixing part 192 that may fix the detergent bottle 200 to the seat 184, a detergent inlet 194 into which the liquid detergent is entered, a sealing part (not shown) that prevents the leakage of the liquid detergent flowing from the detergent bottle into the detergent inlet 194, and may also include a check valve 198 that prevents the back-flow of the liquid detergent stored in the detergent reservoir 186 when the detergent bottle 200 is removed from the reservoir 186.

The detergent inlet 194 provides fluid communication between the detergent bottle 200 and the detergent reservoir 186 so that the liquid detergent may flow into and be stored in the detergent reservoir 186. The detergent inlet 194 may be formed so that the liquid detergent contained in the detergent bottle 200 may flow passively by the natural force of gravity into the detergent reservoir 186. The detergent inlet 194 preferably includes the sealing part 196 to prevent leakage as the liquid detergent flows through the inlet 194. Additionally, a one-way flow through the detergent inlet 194 is preferably controlled closed by the check valve 198 when liquid detergent is not actively flowing into the detergent reservoir 186.

The detergent reservoir 186 may store the liquid detergent supplied from the detergent bottle 200 and is preferably provided in plurality so that a plurality of detergent bottles may be used. As illustrated in FIG. 3, three detergent storing parts 186 may be provided. The detergent reservoir 186 is preferably provided inside the storage drawer 181 and may include a sensor 188 that senses a level of liquid detergent stored in the reservoir 186. The sensor 188 may sense when the amount of the liquid detergent stored in the detergent reservoir 186 is not sufficient according to what is needed for a washing cycle. When this situation is sensed the washing machine may be provided with one or more ways to alert a user of this situation.

As illustrated in FIGS. 2 and 3, a detergent pump 168, e.g. a tube pump, a detergent fluid passage 164, and a detergent passage storing part 166 may be provided in the supporting frame 161. The detergent fluid passage 164 connects the detergent reservoir 186 with the detergent pump 168 so that the detergent pump 168 may supply the liquid detergent stored in the reservoir 186 to the washing tub 120. The detergent fluid passage supporting part 166 acts to support the detergent fluid passage 164 as the storage drawer 181 is opened and closed.

The detergent pump 168 pumps the liquid detergent stored in the detergent reservoir 186 through a detergent supply fluid passage 151 to the mixing part 133. The detergent pump 168 is preferably implemented as a tube pump that extrudes the liquid detergent through the detergent fluid passage 164. When the detergent fluid passage 164 is provided in plurality corresponding to the plurality of detergent reservoirs 186, a plurality of detergent pumps 168 may also be provided. Embodiments of the present invention, however, may also be configured so that a single detergent fluid passage 164 and a single detergent pump 168 are provided for the plurality of detergent storing parts 186.

The detergent pump 168 is preferably operated so that the liquid detergent may be automatically supplied via predetermined algorithms of the controller 118. The controller 118 may determine the appropriate amount of liquid detergent necessary depending on the amount of laundry, type of laundry, concentration of the liquid detergent, degree of soiling of the laundry, or a variety of other variables.

The detergent fluid passage supporting part 166 may connect the storage drawer 181 with the supporting frame 161 and further preferably supports the detergent fluid passage 164. The detergent fluid passage supporting part 166 preferably has joints that retract and extend depending on whether the storage drawer 181 is opened or closed. It is noted that the detergent fluid passage supporting part 166 may be omitted when the detergent fluid passage 164 is itself implemented to be otherwise independently extendable/retractable in a manner known by those skilled in the art.

Figure 4:
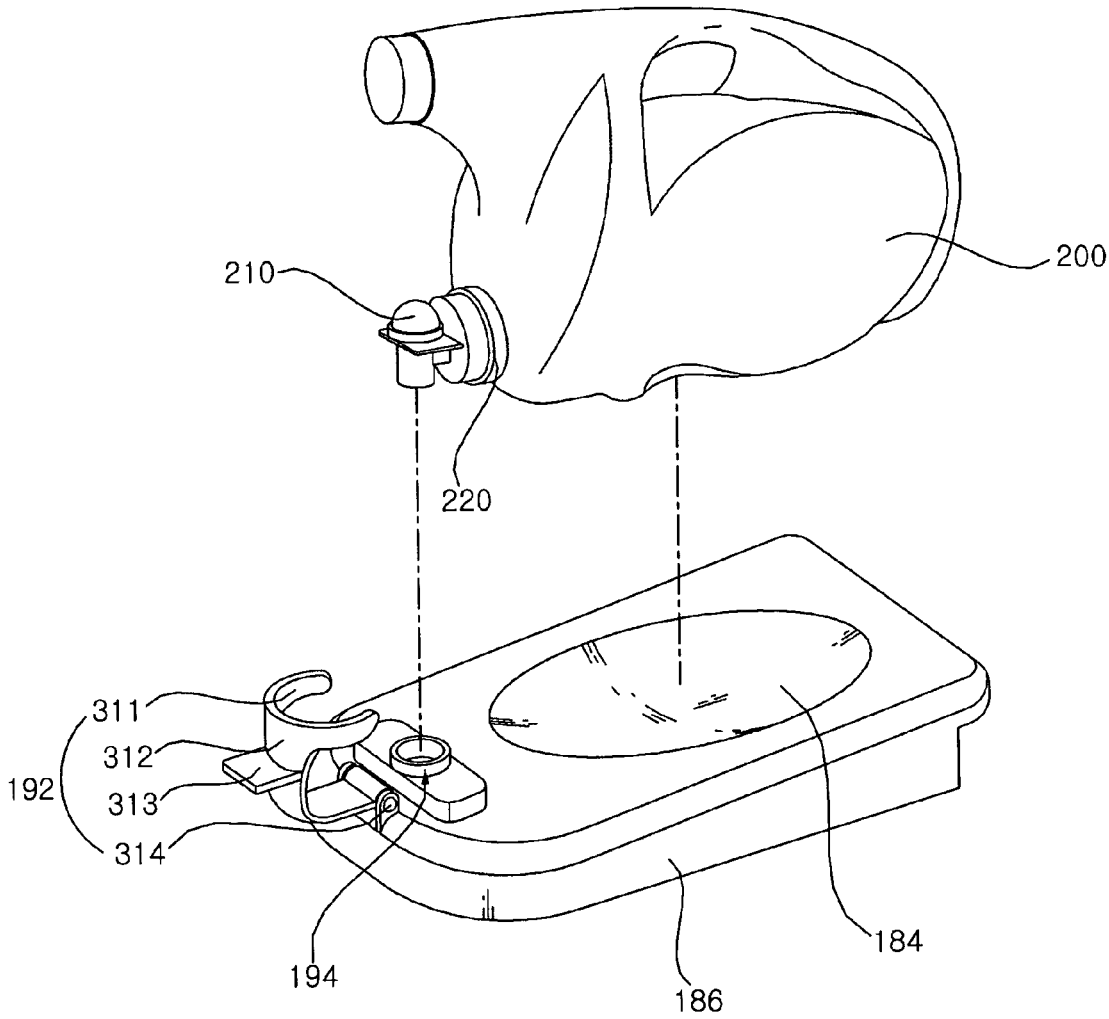
FIGS. 4 and 5 are detailed perspective views illustrating a detergent bottle fixing part included in a washing machine according to an exemplary embodiment of the present invention.
Figure 5:
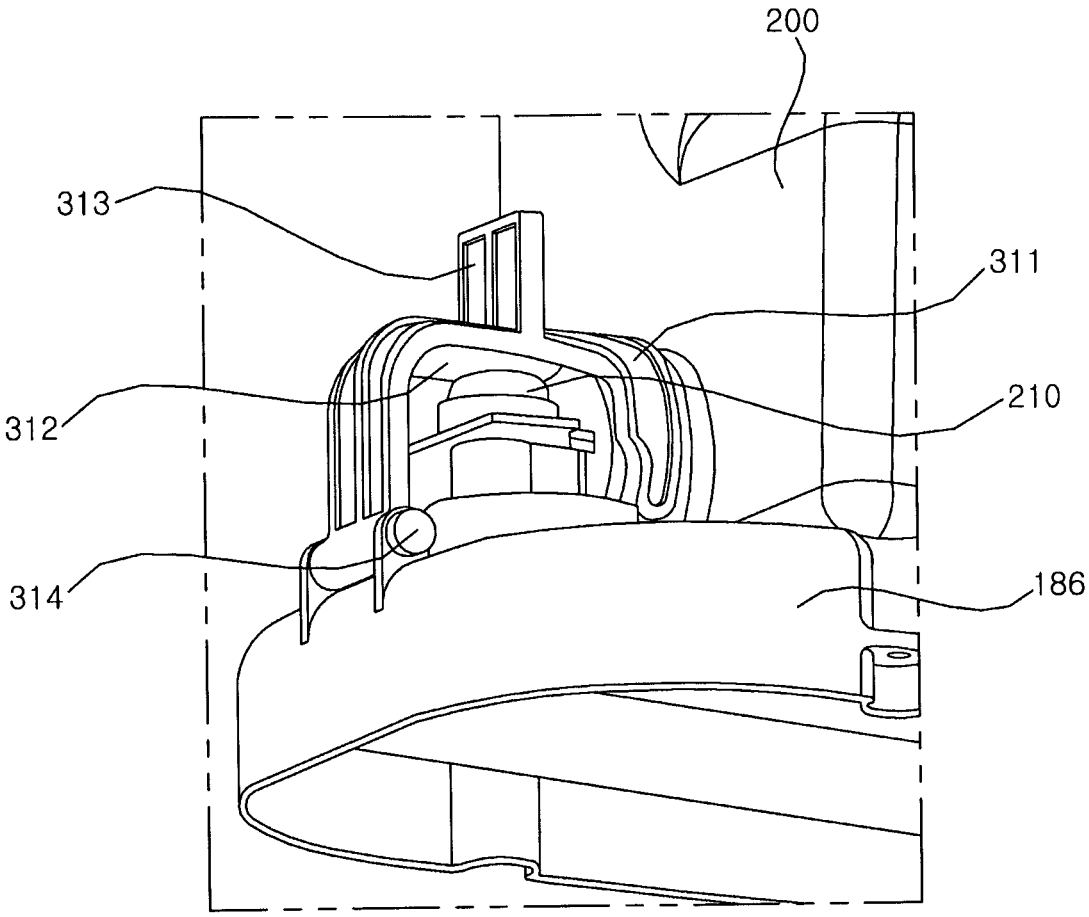

FIGS. 4 and 5 illustrate in more detail an embodiment of the detergent bottle fixing part 192 included in the washing machine according to an exemplary embodiment of the present invention.

The detergent bottle fixing part 192 may include an outlet fixing part 311 that fixes a detergent outlet 220 of the detergent bottle 200 to the reservoir 186. A button pressing part 312 may act to press or otherwise engage a detergent outlet button 210 of the detergent bottle 200. A handle part 313 may enable a user to rotate the detergent bottle fixing part 192 by hand, and a hinge part 314 may connect the detergent bottle fixing part 192 with the detergent reservoir 186 so that the detergent bottle fixing part 192 may pivot to engage the detergent bottle 200.

The outlet fixing part 311 may maintain the detergent outlet 220 of the detergent bottle 200 in a stationary position and may be implemented variously depending on the shape of the detergent outlet 220. In the exemplary embodiment of the present invention, the outlet fixing part 311 may be implemented to be shaped as an open circle to receive the circle-shaped detergent outlet 220.

The button pressing part 312 may press the detergent outlet button 210 upon fixation of the detergent bottle 200. It is noted that the button pressing part may be implemented variously depending on the location and shape of the detergent outlet mechanism and is not limited to a button-type interaction. In the exemplary embodiment of the present invention, the button pressing part 312 is implemented to be shaped as a plate extended from the outlet fixing part 311.

The handle part 313 enables the user to rotate the detergent bottle fixing part 192. In the exemplary embodiment of the present invention, the handle part 313 may be implemented to be shaped as a plate that is formed perpendicular to the outlet fixing part 311. The hinge part 314 pivotally connects the detergent bottle fixing part 192 with the detergent reservoir 186 so that the detergent bottle fixing part 192 may rotate.

The structure of the aforementioned detergent bottle fixing part 192 may be implemented variously by those skilled in the art depending on the shape of the commercially available detergent bottle 200 that is chosen.

An operation of the washing machine according to the exemplary embodiments of the present invention, as configured above, will be described as follows.

In one embodiment, the storage drawer 181 is withdrawn so that the detergent bottle 200 may be placed on the detergent bottle seat 184, and the detergent bottle fixing part 192 of the detergent bottle connecting part 190 receives the detergent bottle 200. When the detergent bottle 200 is in fluid-communicates with the detergent reservoir 186, the liquid detergent contained in the detergent bottle 200 is supplied through the detergent inlet 194 and stored in the detergent reservoir 186.

The door 112 is opened so that laundry is placed in the drum 124 of the washing tub 120. Once the door 112 is closed and sealed, the washing machine 100 may operate such that the amount of laundry placed in the drum 124 is sensed and the controller 118 may set the level of water supply, the supply amount of the detergent, washing time, and the like according to the amount of laundry. Of course, wash parameters may alternatively be set manually, by a user.

The washing water supply valve 131 is opened so that a predetermined amount of washing water may be supplied from an external water source. In addition, the detergent pump 168 may operate so that a predetermined amount of liquid detergent stored in the detergent reservoir 186 may be supplied to the tub 120. When plural detergent storing parts 186 are provided, preferably only a liquid detergent for washing and/or bleaching may be supplied.

When the detergent pump 168 operates, the liquid detergent stored in the detergent reservoir 186 flows via the detergent fluid passage 164 and the detergent supply fluid passage 151 into the mixing part 133. The washing water and the liquid detergent may then be mixed in the mixing part 133 and flow into the tub 122 of the washing tub 120 through the liquid detergent/water supply delivery passage 134.

When the washing water and the liquid detergent are ready to be supplied to the tub 122, the driving part 113 operates to rotate the drum 124 for a predetermined time period. At this time, the washing water and the liquid detergent are circulated throughout the washing tub 120 by the circulation pump 136 (FIG. 1).

Once the above-mentioned process is complete, the driving part 113 stops and the water discharge pump 142 operates to discharge the soiled washing water and used liquid detergent outside. Then the washing water supply valve 131 is re-opened so that the washing water may be supplied for rinsing. The detergent pump 168 may operate to supply a predetermined amount of liquid detergent for rinsing (fabric softener).

The washing water and the liquid detergent may be mixed in the mixing part 133 and flow into the tub 122 of the washing tub 120 through the liquid detergent/water delivery passage 134, as the driving part 113 rotates the drum 124 for a predetermined time period. Accordingly, a rinsing process may thus be performed as described above.

When the abovementioned rinsing process is complete, the driving part 113 stops and the water discharge pump 142 operates to discharge the soiled washing water and the rinsing liquid detergent outside. Then a dehydrating process and a drying process may be performed according to a predetermined set of instructions.

When the amount of the liquid detergent stored in the detergent reservoir 186 is insufficient for washing, the sensor 188 senses this and the status may be externally displayed.

Figure 6:
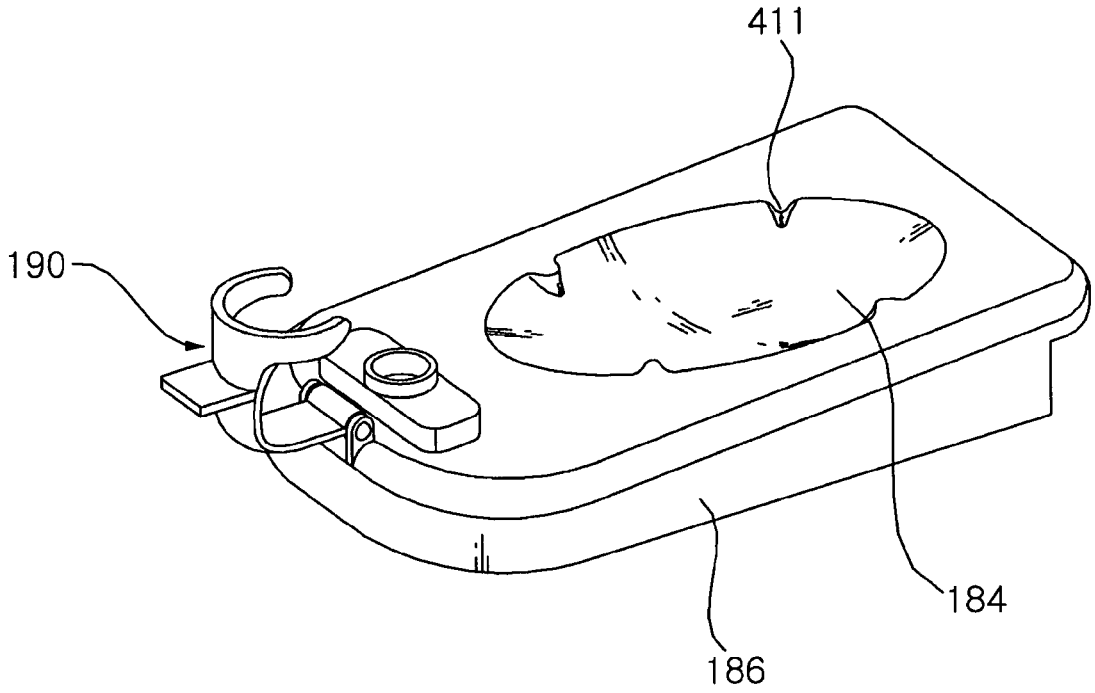
FIG. 6 is a perspective view illustrating a detergent bottle seating part included in a washing machine according to another exemplary embodiment of the present invention.

FIG. 6 illustrates a detergent reservoir 186 which may be included in a washing machine according to another exemplary embodiment of the present invention.

The detergent bottle seat 184 includes a detergent bottle fixing protrusion 411 that may fix or position the detergent bottle 200 in place. The detergent bottle fixing protrusion 411 may be implemented variously depending on the shape of the detergent bottle 200 so as to be capable of maintaining the detergent bottle 200 in a stationary position on the detergent bottle seat 184.

Figure 7:
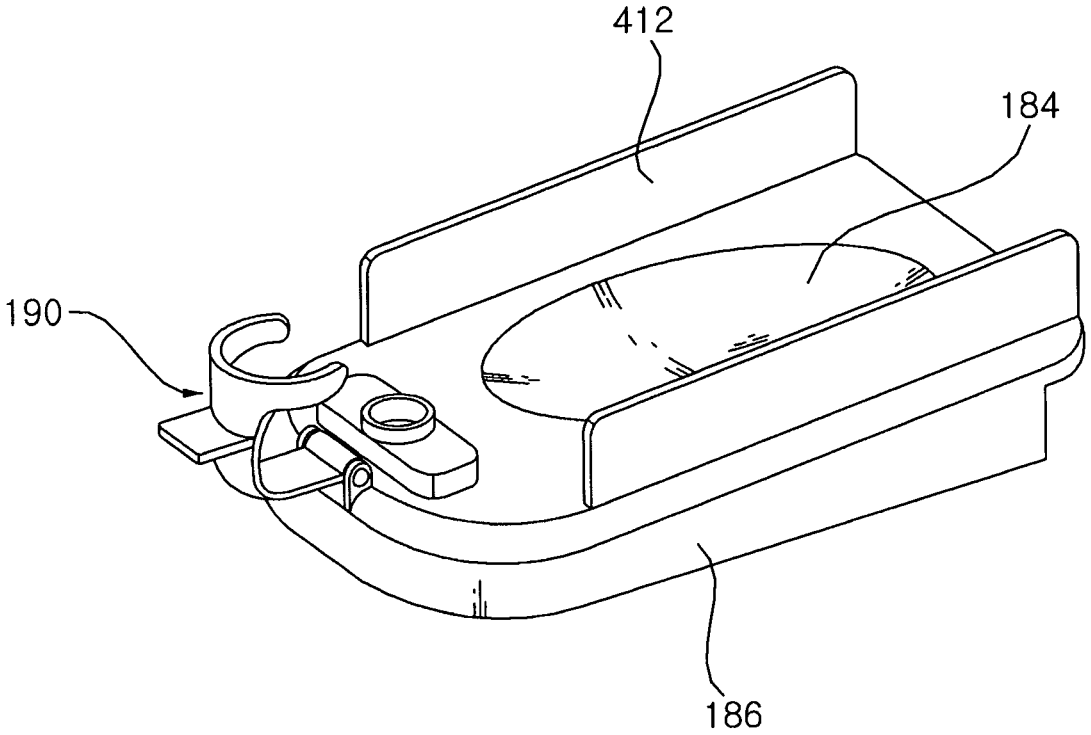
FIG. 7 is a perspective view illustrating a detergent bottle seating part included in a washing machine according to still another exemplary embodiment of the present invention.

FIG. 7 is a view illustrating a detergent bottle seat 184 included in a washing machine according to still another exemplary embodiment of the present invention.

The detergent bottle seat 184 includes a detergent bottle supporting part 412 that is adapted to prevent lateral movement or axial rotation of the detergent bottle 200. The detergent bottle supporting part 412 may be implemented variously depending on the shape of the detergent bottle 200.

Figure 8:
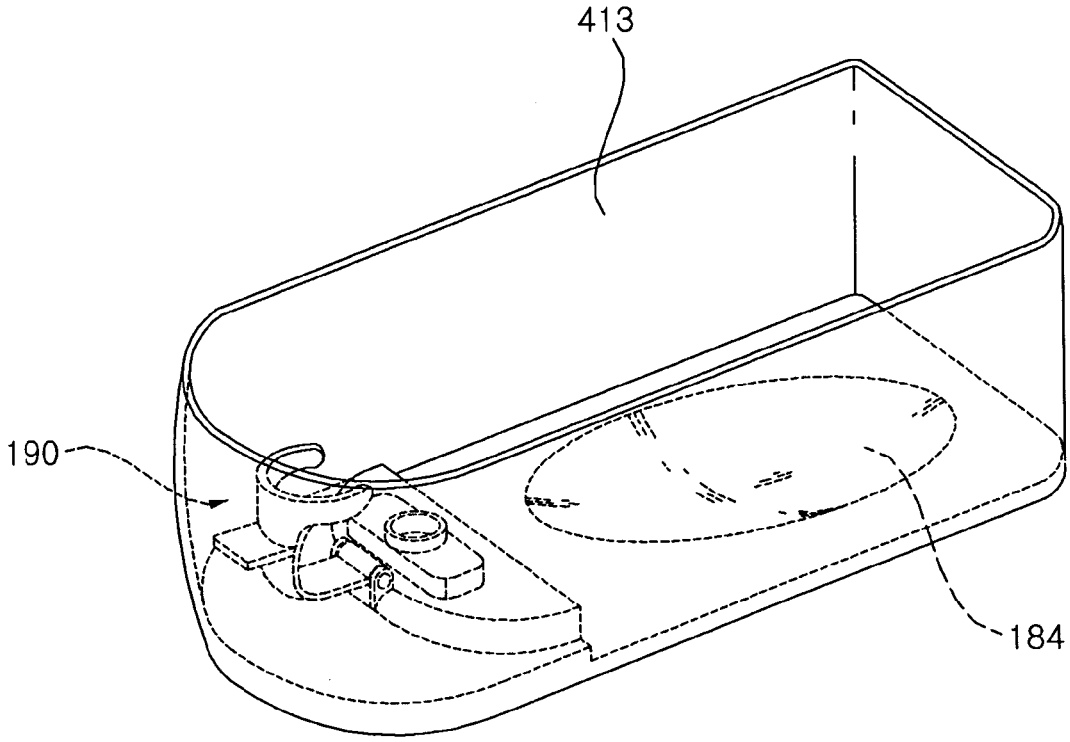
FIG. 8 is a perspective view illustrating the structure of a detergent bottle seating part and a detergent reservoir 186 included in a washing machine according to yet still another exemplary embodiment of the present invention.

FIG. 8 is a view illustrating the structure of a detergent bottle seat 184 and a detergent reservoir 413 included in a washing machine according to yet still another exemplary embodiment of the present invention.

The detergent reservoir 413 may be opened at its top. The detergent bottle seat 184 and the detergent bottle connecting part 190 may be provided at a lower part in the detergent reservoir 413. In use, the detergent bottle 200 may be placed at an inside of the detergent reservoir 413, or alternatively the liquid detergent may be directly poured into the detergent reservoir 413.

Figure 9:
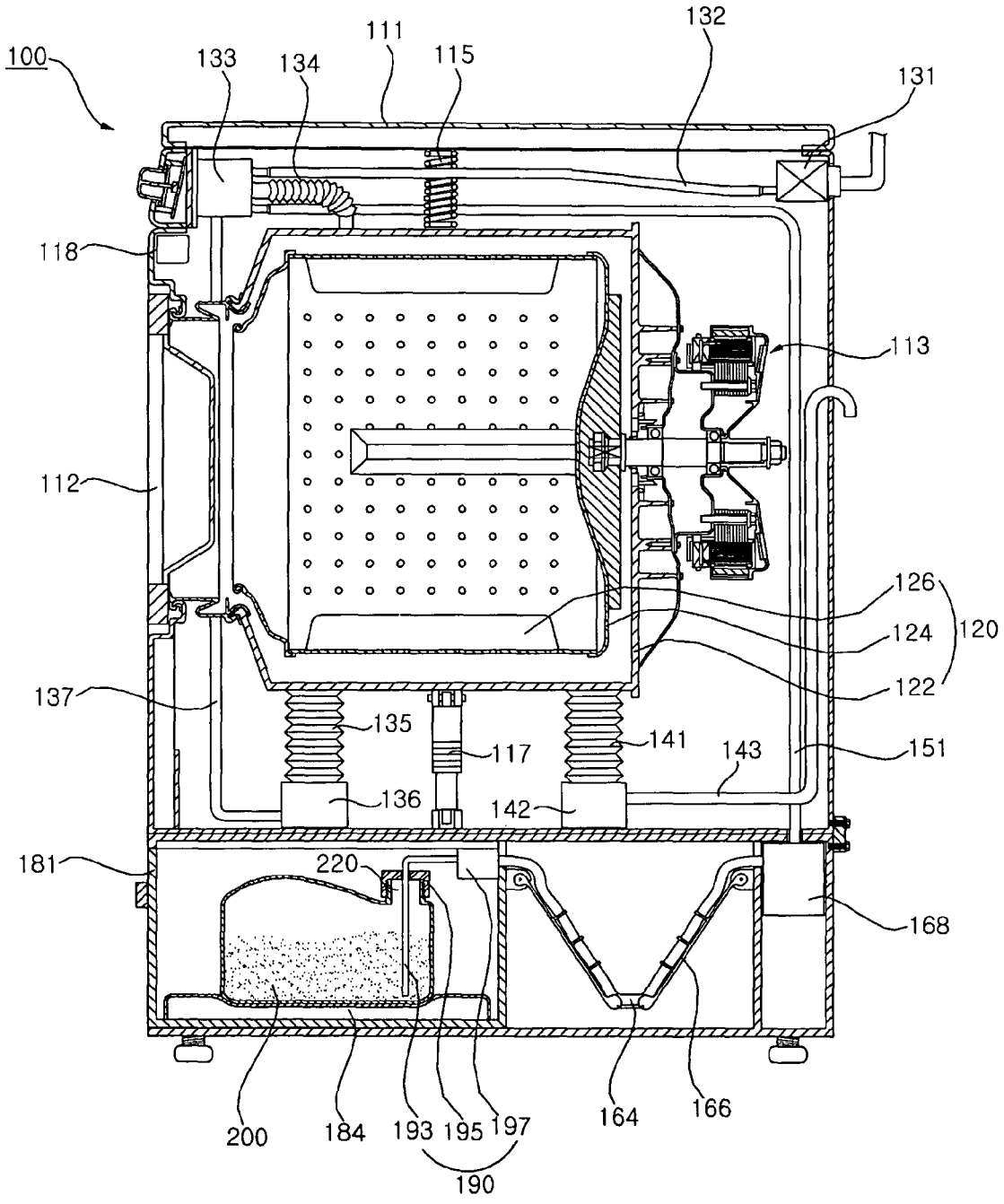
FIG. 9 is a side cross sectional view illustrating a washing machine according to another exemplary embodiment of the present invention.

FIG. 9 is a side cross sectional view illustrating a washing machine according to another embodiment of the present invention.

The inner structure or implementing method of the washing tub 120, the case 111, and the supporting frame 161 may be similar to that described above with reference to the exemplary embodiment of the present invention, and accordingly, the inner structure of the storage drawer 181 will be only described hereinafter.

The storage drawer 181 included in the washing machine, according to the embodiment illustrated in FIG. 9, may include a detergent bottle seat 184 on which a detergent bottle 200 containing a liquid detergent may be seated, and a detergent bottle interface 190 coupled to the detergent bottle 200, through which the liquid detergent is supplied.

The structure or implementing method of the detergent bottle seat 184 may be similar to that described above with reference to previously described embodiments of the present invention.

The detergent bottle interface 190 included in the embodiment of FIG. 9 may include an extension tube 193 inserted into the detergent bottle 200, a connection cap 195 through which the extension tube 193 may pass and which covers the detergent outlet 220 of the detergent bottle 200, and a pump 197 that draws the liquid detergent into and through the extension tube 193.

The extension tube 193 may be inserted into the detergent bottle 200 through the detergent outlet 220 of the detergent bottle 200 to allow the pump 197 to suck the liquid detergent from the detergent bottle 200. The extension tube 193 penetrates the connection cap 195 and preferably has such a length that its end may reach the bottom of the detergent bottle 200. The extension tube 193 may be coupled to the pump 197, and if the pump 197 is omitted, the extension tube 193 may be coupled to the detergent fluid passage 164.

The connection cap 195 may cover the detergent outlet 220 of the detergent bottle 200 and the extension tube 193 may pass through a portion of the connection cap 195. The connection cap 195 is preferably implemented so that various types of detergent bottles 200 may be coupled with the connection cap 195. Preferably, an elastic member is provided at an inside of the connection cap 195 to seal the detergent outlet 220 and prevent contamination of liquid detergent inside the bottle 200.

The pump 197 that draws the liquid detergent from the detergent bottle 200 through the extension tube 193 may be provided adjacent to an end of the extension tube 193. The pump 197 is preferably implemented as a suction-type pump. It is noted that the pump 197 may be omitted as long as a system is provided for the liquid detergent in the detergent bottle 200 to be drawn into extension tube 193.

An operation of the washing machine according to another exemplary embodiment of the present invention as configured above, will be described as follows.

The storage drawer 181 is withdrawn so that the detergent bottle 200 may be seated on the detergent bottle seat 184, and the extension tube 193 is inserted into the detergent outlet 220 of the detergent bottle 200. The connection cap 195 then may cover the detergent outlet 220 of the detergent bottle 200.

The door 112 is opened so that laundry is placed in the drum 124 of the washing tub 120. Once the door 112 is closed and sealed, the washing machine 100 may operate such that the amount of laundry placed in the drum 124 is sensed and the controller 118 sets the level of water supply, the supply amount of the detergent, washing time, and the like according to the amount of laundry. Of course, washing parameters may be manually input to the washing machine by the user.

The washing water supply valve 131 may be opened so that a predetermined amount of washing water may be supplied from an external water source. In addition, the pump 197 may operate to draw the liquid detergent from the detergent bottle 200 through the extension tube 193. The detergent pump 168 may then operates to supply a predetermined amount of the drawn liquid detergent to the mixing part 133. If no pump 197 is provided, the detergent pump 168 operates alone to pump the liquid detergent from the detergent bottle 200.

When the detergent pump 168 operates, the liquid detergent flows into the mixing part 133 via the detergent fluid passage 164 and the detergent supply fluid passage 151.

The remaining washing process is similar to that of the washing machine according to the previously described embodiments of the present invention. Upon a rinsing process, the pump 197 and the detergent pump 168 operate again, so that the liquid detergent for rinsing may be supplied from the detergent bottle 200. When no pump 197 is provided, the detergent pump 168 operates alone to supply the detergent.

Even though the present invention has been described with reference to accompanying drawings, the present invention is not limited to the above embodiments, which are exemplary only, and may be modified or varied by those skilled in the art without departing from the spirit and scope of the present invention. Accordingly, the exemplary embodiments disclosed herein.

Even though it has been described that the items to be washed are laundry items and the washing space is the washing tub, the present invention is not limited thereto. For example, the detergent supply apparatus may be applied to other washing apparatuses such as a dish washer having different items to be washed and a different washing space from that of the washing machine.

Furthermore, the present invention is limited to the drum-type washing machine and may be also applied to other types of washing machines such as a pulsator type or agitator type washing machine, including washing machines in which detergent is poured directly into the tub without any use of a mixing part 133.

The foregoing embodiments and advantages are merely exemplary and are not to be construed as limiting the present invention. The present teaching can be readily applied to other types of apparatuses. The description of the foregoing embodiments is intended to be illustrative, and not to limit the scope of the claims. Many alternatives, modifications, and variations will be apparent to those skilled in the art.

What is claimed is:

1. A washing machine comprising:

a case;

a washing tub that washes laundry;

a storage drawer provided under the washing tub;

a supporting frame provided under the case and having the storage drawer;

a detergent bottle seat provided inside of the storage drawer to receive a detergent bottle containing a liquid detergent;

a detergent reservoir provided inside of the storage drawer and in fluid communication with the detergent bottle;

a connecting part adapted to fix a portion of the detergent bottle to the detergent reservoir such that the liquid detergent can flow through the connecting part and into the detergent reservoir by gravitational force, a pump provided in the supporting frame to supply the liquid detergent stored in the detergent reservoir to the washing tub;

a detergent fluid passage connecting the detergent reservoir with the pump; and a detergent fluid passage supporting part connecting the storage drawer with the supporting frame and supporting the detergent fluid passage, wherein the detergent fluid passage supporting part has joints that retract and extend depending on whether the storage drawer is opened or closed, wherein the detergent bottle seat is formed in an upper surface of the detergent reservoir, and wherein the connecting part is connected to the front of the detergent reservoir and the detergent fluid passage is connected to the rear of the detergent reservoir, the front of the detergent reservoir is disposed at the front side of the inside of the storage drawer and the rear of the detergent reservoir is disposed at the rear side of the inside of the storage drawer.

2. The washing machine of claim 1, wherein the detergent bottle seat is formed to fit a shape of a side surface of the detergent bottle.

3. The washing machine of claim 1, wherein the detergent bottle seat is formed of an elastic member adapted to conform to a contoured surface of the detergent bottle.

4. The washing machine of claim 1, wherein the detergent bottle seat includes a detergent bottle support adapted to support the detergent bottle and prevent lateral movement or axial rotation.

5. The washing machine of claim 1, wherein the connecting part includes:

a detergent inlet adapted to receive a flow of the liquid detergent from the detergent bottle; and a sealing part adapted to prevent leakage as the liquid detergent flows through the detergent inlet.

6. The washing machine of claim 1, wherein the connecting part includes:

a detergent inlet adapted to receive a flow of the liquid detergent from the detergent bottle; and a check valve adapted to prevent back-flow of the liquid detergent from the detergent inlet.

7. The washing machine of claim 1, wherein the detergent bottle connecting part is inserted into the detergent bottle and adapted to draw the liquid detergent from the detergent bottle.

8. The washing machine of claim 1, wherein the detergent bottle connecting part includes:

an extension tube inserted into the detergent bottle; and a connection cap covering an outlet of the detergent bottle and receiving the extension tube therethrough.

9. The washing machine of claim 7, wherein the detergent bottle connecting part further includes a suction pump to draw the liquid detergent through the extension tube.

10. The washing machine of claim 1, wherein the pump pumps by extruding the liquid detergent through the detergent fluid passage.

11. The washing machine of claim 1, further comprising:

a controller adapted to control the liquid supply apparatus to automatically supply the liquid detergent during a washing cycle.

* * * * *